US009093212B1

(12) United States Patent
Pinkerton et al.

(10) Patent No.: US 9,093,212 B1
(45) Date of Patent: Jul. 28, 2015

(54) STACKED STEP GAP CORE DEVICES AND METHODS

(75) Inventors: Deborah Pinkerton, Madison, AL (US); Donald Folker, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 0 days.

(21) Appl. No.: 13/461,400

(22) Filed: May 1, 2012

(51) Int. Cl.

| | |
|---|---|
| ***H01F 17/06*** | (2006.01) |
| ***H01F 27/24*** | (2006.01) |
| ***H01F 7/06*** | (2006.01) |
| ***H01F 41/02*** | (2006.01) |

(52) U.S. Cl.
CPC ..... *H01F 27/24* (2013.01); *H01F 41/02* (2013.01)

(58) Field of Classification Search
CPC ..... H01F 3/14; H01F 27/24; H01F 41/02
USPC ..... 336/212, 178, 221, 214, 215, 234, 198, 336/208; 29/602.1, 606, 607, 609
See application file for complete search history.

(56) References Cited

U.S. PATENT DOCUMENTS

| | | | | |
|---|---|---|---|---|
| 2,319,775 | A * | 5/1943 | Mittermaier | 336/100 |
| 4,827,237 | A * | 5/1989 | Blackburn | 336/212 |
| 5,155,676 | A | 10/1992 | Spreen | |
| 5,440,225 | A | 8/1995 | Kojima | |
| 6,657,528 | B1 | 12/2003 | Tang | |
| 6,774,758 | B2 * | 8/2004 | Gokhale et al. | 336/234 |
| 6,816,054 | B2 * | 11/2004 | Lin | 336/234 |
| 7,646,281 | B2 * | 1/2010 | Diekmann et al. | 336/234 |
| 8,035,472 | B2 * | 10/2011 | Vail | 336/212 |
| 2003/0048644 | A1 * | 3/2003 | Nagai et al. | 363/21.09 |
| 2007/0159289 | A1 * | 7/2007 | Lee et al. | 336/212 |
| 2010/0085138 | A1 | 4/2010 | Vail | |
| 2010/0289607 | A1 * | 11/2010 | Liu et al. | 336/65 |
| 2010/0321958 | A1 * | 12/2010 | Brinlee et al. | 363/21.1 |

OTHER PUBLICATIONS

Magnetics, Bulletin FC-S4,"Step-gap "E" core swing chokes: Improved regulation and higher efficiency are possible when operating at minimum current levels" pp. 1-4 (Jan. 2001).

* cited by examiner

*Primary Examiner* — Mangtin Lian
(74) *Attorney, Agent, or Firm* — Patterson Intellectual Property Law, P.C.; Mark J. Patterson; Jerry Turner Sewell

(57) ABSTRACT

A core apparatus for a magnetic component includes first and second E-cores stacked with legs extending in the same direction. The first E-core includes a middle first core leg having a middle first core leg length, and the second E-core includes a middle second core leg having a middle second core leg length greater than the middle first core leg length such that a step is formed between the distal ends of the middle legs of the first and second E-cores. A third E-core may be positioned opposite the stacked first and second E-cores forming a stepped air gap between the middle first and second core legs and the middle third core leg.

10 Claims, 4 Drawing Sheets

STACKED STEP GAP CORE DEVICES AND METHODS

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to magnetic devices for electronic circuits and associated methods of assembly and more particularly to stacked core devices for providing a middle core leg with a stepped end profile and associated methods for assembling stacked step gap core components.

Magnetic components for electronic circuits, including inductors and transformers, are known in the art. Some conventional step gap inductors and transformers include a category of magnetic components that provide a stepped air gap, or an air gap having a stepped profile, defined between opposing legs of a magnetic flux loop. The stepped air gap provides improved performance of the core apparatus and the magnetic component that includes the core.

Conventional core devices including a stepped air gap commonly use a first, non-stepped E-core positioned opposite a second E-core including a middle leg having a stepped end profile. The first, non-stepped E-core includes a middle leg extending toward the middle leg of the second E-core, and a stepped gap is defined between the distal ends of the two middle legs. The stepped gap includes two widths corresponding to the stepped profile of the middle leg on the second E-core. For example, U.S. Patent Publication No. 2010/00852138 illustrates a conventional core device including first and second opposing E-cores defining a vertical stepped gap between the middle legs of the two E-cores.

One problem associated with conventional step gap core devices and associated magnetic components such as inductors and transformers includes the expense, difficulty and unreliability of manufacture. The step gap profile in conventional step gap inductors and transformers is generally formed by grinding the desired stepped profile into the distal end of the middle leg of one of the E-cores.

Conventional methods of grinding step gap core assemblies for inductors and transformers is problematic because it is difficult to accurately and consistently grind a specific dimension step gap on a ferrite core. The step gap includes horizontal and vertical dimensions that must be accurately maintained to ensure proper performance of the magnetic component. Additionally, in a manufacturing environment wherein numerous core devices are produced, cores must be consistently ground to the same dimensional tolerances to ensure consistent performance between magnetic devices that include the ground cores. However, the conventional grinding process leads to large dimensional tolerance ranges which adversely affect component performance and reliability. When the dimensions of the step gap are not precise, undesirable variability in performance of the magnetic components results.

What is needed then are improvements in step gap cores, magnetic components utilizing step gap cores and methods of manufacturing magnetic step gap cores and components having step gap cores.

BRIEF SUMMARY

The present invention provides a core apparatus including a middle core leg having a stepped end profile. The core apparatus includes a first E-core stacked on a second E-core. The two E-cores have middle core legs of different lengths. As such, a step is formed at the end of the combined middle leg on the core apparatus.

In a first embodiment, the present invention provides a core apparatus for a magnetic component. The core apparatus includes a first E-core including a middle first core leg having a middle first core leg length. The core apparatus also includes a second E-core including a middle second core leg having a middle second core leg length greater than the middle first core leg length. The first and second E-cores are stacked against each other such that the middle first core leg and the middle second core leg are located adjacent each other and extend in substantially the same direction. The middle first core leg and the middle second core leg form a stepped end profile.

In another embodiment, the present invention provides a core apparatus for a magnetic component. The core apparatus includes a first E-core including a first core body, a first outer first core leg, and a second outer first core leg. The first and second outer first core legs extend from the first core body at opposite ends of the first core body. The first and second outer first core legs extend substantially transversely to the direction of orientation of the first core body. The first E-core includes a middle first core leg extending from the first core body between the first and second outer first core legs in substantially the same direction as the first and second outer first core legs. The middle first core leg includes a middle first core leg length. A second E-core includes a second core body, a first outer second core leg, and a second outer second core leg. The first and second outer second core legs extend from opposite ends of the second core body. The first and second outer second core legs extend substantially transversely to the direction of orientation of the second core body. The second E-core includes a middle second core leg extending from the second core body between the first and second outer second core legs in substantially the same direction as the first and second outer second core legs. The middle second core leg includes a middle second core leg length greater than the middle first core leg length. The first and second E-cores are stacked such that the middle first core leg is positioned adjacent the middle second core leg.

In a further embodiment, the present invention provides a method of manufacturing a core apparatus. The method includes the steps of: (a) providing first and second E-cores, the first E-core having a middle first core leg including a middle first core leg length, and the second E-core having a middle second core leg including a middle second core leg length greater than the middle first core leg length; (b) stacking the first and second E-cores such that the middle first core leg is positioned adjacent the middle second core leg, wherein the middle first core leg distal end and the middle second core leg distal end extend in substantially the same direction; and (c) providing a step between the middle first core leg distal end and the middle second core leg distal end.

It is a further object of the present invention to provide a core assembly, or core apparatus, for a magnetic component that includes three E-cores, wherein two E-cores are stacked together and positioned opposite the third E-core.

It is another object of the present invention to provide a method of manufacturing a core apparatus for a magnetic component having two or more stacked E-cores forming a stepped end profile on the combined middle leg formed by the two or more stacked E-cores.

Another object of the present invention is to provide a method of manufacturing a transformer including at least three E-cores, wherein two E-cores having differently sized middle legs are stacked to form a combined middle leg having a stepped end profile.

Yet another object of the present invention is to provide a magnetic component such as a transformer or an inductor that includes a core apparatus having at least two stacked E-cores opposite a third E-core forming a stepped-gap profile between the opposite cores.

Numerous other objects, advantages and features of the present invention will be readily apparent to those of skill in the art upon a review of the following drawings and description of a preferred embodiment.

DETAILED DESCRIPTION

Figure 1:
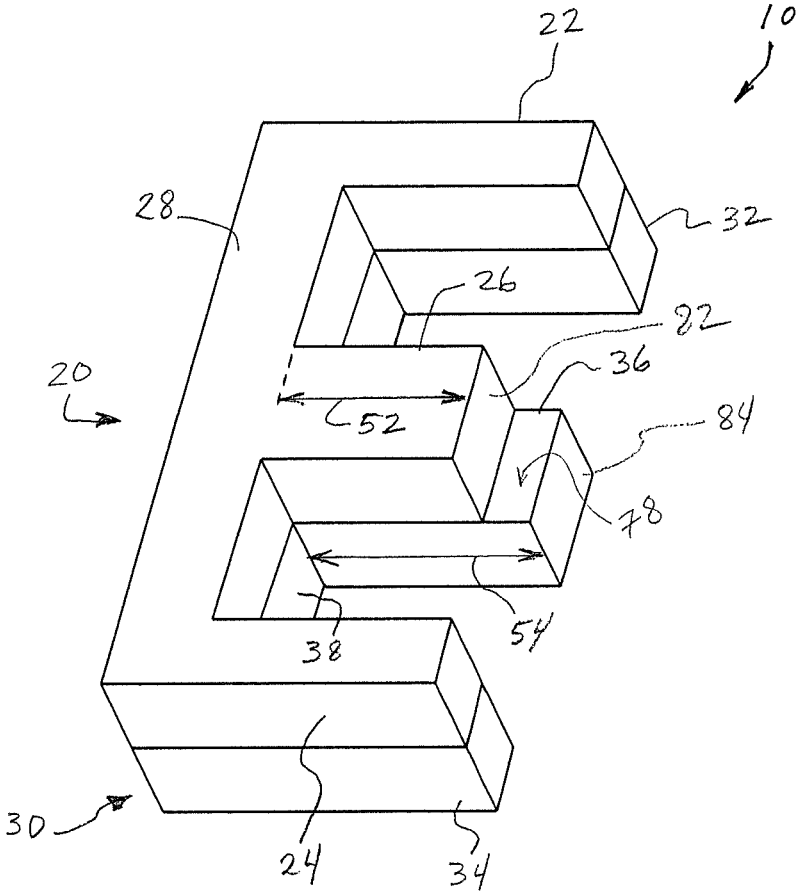
FIG. 1 is a perspective view of an embodiment of a core apparatus in accordance with the present invention.

Referring now to the drawings, FIG. 1 illustrates an embodiment of a core apparatus 10. Core apparatus 10 includes a first E-core 20 stacked on a second E-core 30. First E-core 20 generally includes a first core body 28. First and second outer first core legs 22, 24 extend from opposite ends of first core body 28. First and second first outer core legs extend substantially transversely to the direction of orientation of first core body 28. In some embodiments, first and second outer first core legs 22, 24 have the same length, or extend the same distance from first core body 28.

A middle first core leg 26 extends from first core body 28 at a location between first and second outer first core legs 22, 24. Middle first core leg 26 is generally spaced from first and second outer first core legs 22, 24 such that a clearance space exists on each side of middle first core leg 26. As seen in FIG. 1, middle first core leg 26 has a middle first core leg length 52 defined as the distance middle first core leg 26 extends from first core body 28. Middle first core leg length 52 may include a standard value known in the art for conventional air gap or non-air gap E-cores.

Referring further to FIG. 1, in some embodiments, a second E-core 30 is stacked against first E-core 20. Second E-core 30 includes a second core body 38 and first and second outer second core legs 32, 34 extending from opposite ends of second core body 38 in a common direction oriented substantially transverse to the direction of orientation of second core body 38. In some embodiments, first and second outer second core legs 32, 34 have the same length, or extend the same distance from second core body 38.

A middle second core leg 36 extends from second core body 38 at a location between first and second outer second core legs 32, 34. Middle second core leg 36 is generally spaced from first and second outer second core legs 32, 34 such that a clearance space exists on each side of middle second core leg 36. As seen in FIG. 1, middle second core leg 36 includes a middle second core leg length 54 defined as the distance middle second core leg 36 extends from second core body 38. Middle second core leg length 54 may include a standard value known in the art for conventional air gap or non-air gap E-cores.

In some embodiments, as seen in FIG. 1, middle second core leg length 54 is greater than middle first core leg length, forming a stepped end profile at the distal end of the combined middle leg formed by middle first core leg 26 and middle second core leg 36. A stepped end profile is characterized by middle second core leg 36 being longer than middle first core leg 26, forming a step between the middle first core leg distal end 82 and the middle second core leg distal end 84. Because middle first core leg distal end 82 does not extend as far as middle second core leg distal end 84, a space is formed above the distal end of middle second core leg 36, forming a step 78 between the middle legs. In some embodiments, the middle first core leg distal end 82 is substantially flat and angled normal to the upper surface of first core 20. Similarly, in some embodiments, the middle second core leg distal end 84 is also substantially flat and is angled normal to the upper surface of second core 30. As seen in FIG. 1, in some embodiments, each middle leg includes a substantially rectangular cross-sectional profile, resulting in a rectangular step 78.

First and second E-cores 20 and 30 are stacked against each other such that middle first core leg 26 is positioned adjacent middle second core leg 36 and such that middle first core leg 26 and middle second core leg 36 extend in substantially the same direction, as seen in FIG. 1.

The stacked end profile on core apparatus 10 seen in FIG. 1 provides a step, or shelf 78, on the exposed upper distal end surface of middle second core leg 36. Step 78 is oriented substantially parallel to the plane of the upper surface of first and second E-cores 20, 30 in some embodiments. A stepped end profile as seen in FIG. 1 may be distinguished from conventional stepped E-cores that include a step feature oriented in a substantially vertical orientation such that the conventional shelf extends substantially transverse to the upper surface of the E-core.

Figure 2:
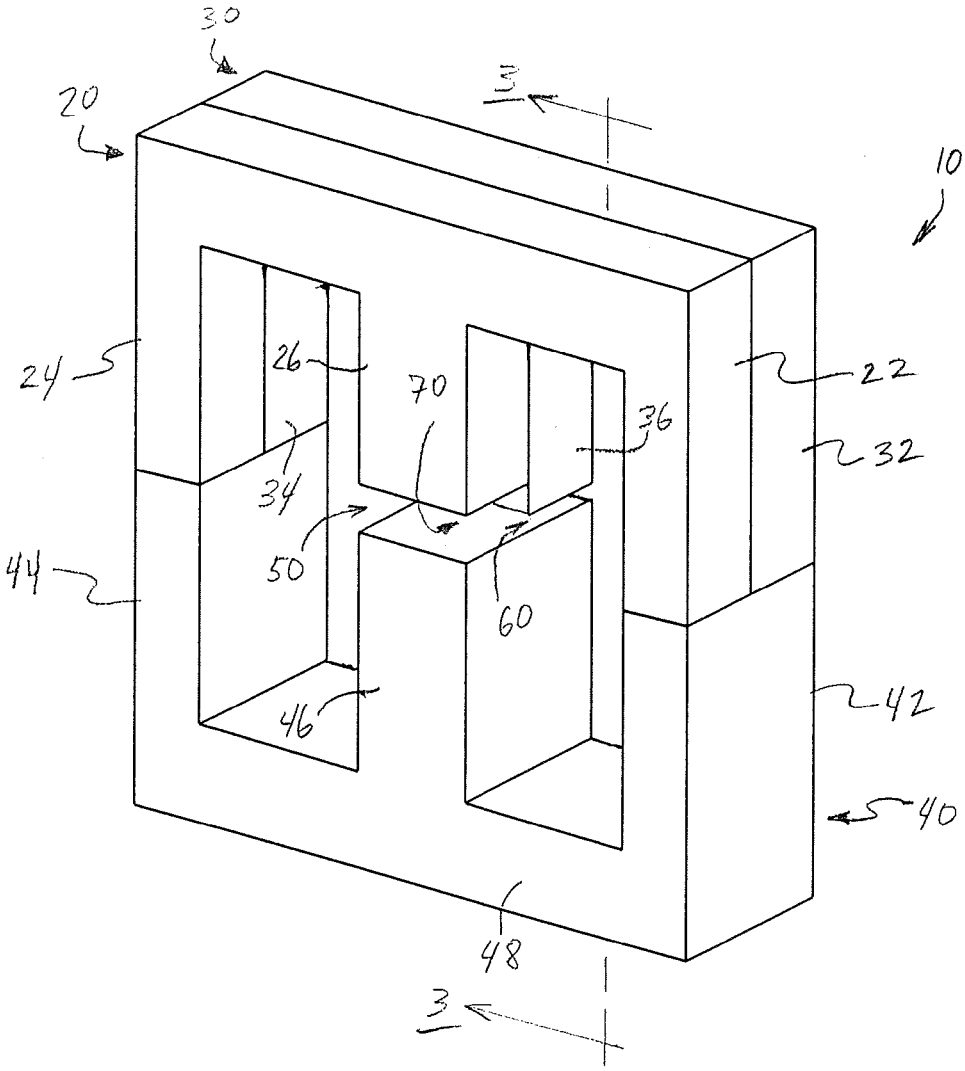
FIG. 2 is a perspective view of an additional embodiment of a core apparatus in accordance with the present invention.

Referring now to FIG. 2, in some embodiments, a third E-core 40 is positioned opposite the stacked first and second E-cores 20, 30. Third E-core 40 includes a middle third core leg 46 extending toward the stacked middle first and second core legs 20, 30.

Figure 3:
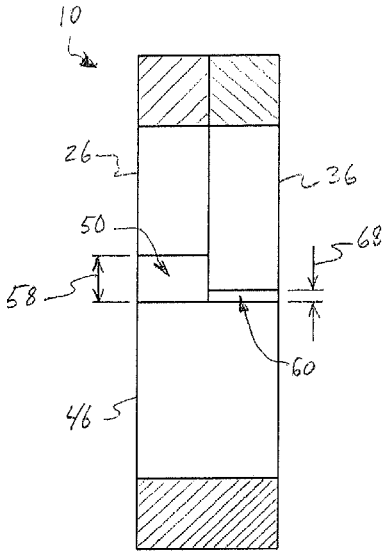
FIG. 3 is a partial cross-sectional view of Section 3-3 from FIG. 2 in accordance with the present invention.

A first gap 50 is defined between the middle third core leg 46 and the middle first core leg 26. First gap 50 may have a rectangular profile in some embodiments. First gap 50 defines a first gap width 58, seen in FIG. 3. First gap width 58 may be substantially uniform in some embodiments.

A second gap 60 is defined between the middle third core leg 46 and the middle second core leg 36. Second gap 60 may have a rectangular profile in some embodiments. Second gap 60 defines a second gap width 68, seen in FIG. 3. Second gap width 68 is substantially uniform in some embodiments. Second gap width 68 is less than first gap width 58 in some embodiments, resulting in a stepped air gap 70, as seen in FIG. 2.

Referring further to FIG. 2, in some embodiments, third E-core 40 includes first and second outer third core legs 42, 44 extending from opposite ends of third core body 48. First and second outer third core legs 42, 44 extend substantially transversely to the orientation direction of third core body 48. In some embodiments, third core 40 is positioned opposite stacked first and second E-cores 20, 30 such that the first outer first core leg 22 and the first outer second core leg 32 both abut the first outer third core leg 42, as seen in FIG. 2. Similarly, when third E-core 40 is positioned opposite stacked first and second E-cores 20, 30, second outer first core leg 24 and second outer second core leg 34 both abut the second outer third core leg 44. In this arrangement, a continuous magnetic flux path is formed around the perimeter of the core apparatus 10, as seen in FIG. 2. A stepped air gap 70 is formed across the middle core legs, as seen in FIG. 2, to provide desired magnetic component performance characteristics in some embodiments.

Figure 4:
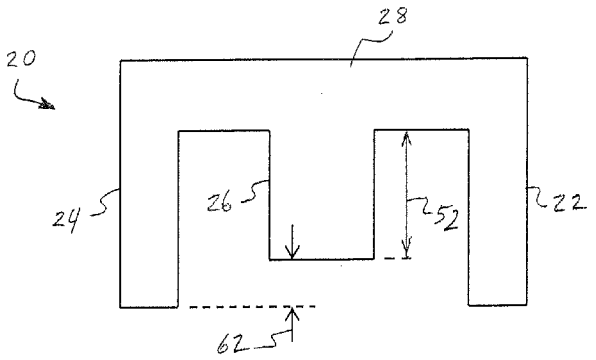
FIG. 4 is a plan view of an embodiment of a first E-core in accordance with the present invention.
Figure 5:
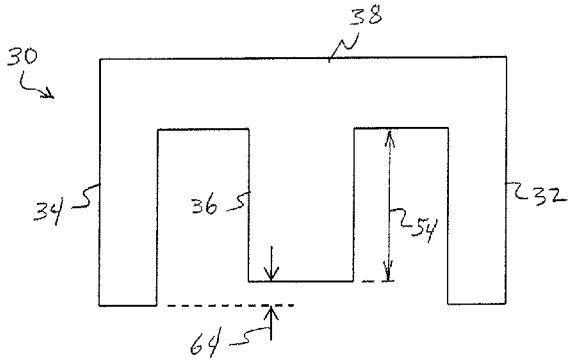
FIG. 5 is a plan view of an embodiment of a second E-core in accordance with the present invention.

Referring now to FIG. 4, in some embodiments, first E-core 20 includes a middle first core leg offset 62 defined as the difference between the length of the first and second outer first core legs 22, 24 and the length of the middle first core leg 26. Middle first core leg offset 62 may include a standardized value corresponding to a conventional E-core. By providing a conventional first E-core 20 having a standardized middle first core leg offset 62, dimensional tolerances may be kept consistent during production, resulting in less dimensional variation between devices. Similarly, as seen in FIG. 5, in some embodiments, second E-core 30 includes a middle second core leg offset 64 defined as the difference between the length of the first and second outer second core legs 32, 34 and the middle second core leg 36. Middle second core leg offset 64 may also include a standardized value corresponding to a conventional E-core known in the art. By providing a conventional second E-core 30 having a pre-defined, or standardized, middle second core leg offset 64, dimensional tolerances may be known and maintained during production, resulting in less dimensional variation between devices. In additional embodiments, middle second core leg offset 64 is zero.

Figure 6:
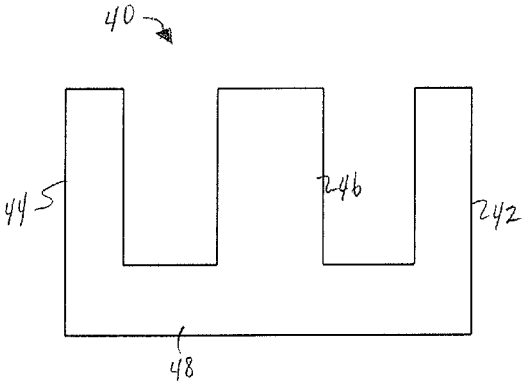
FIG. 6 is a plan view of an embodiment of a third E-core in accordance with the present invention.
Figure 7:
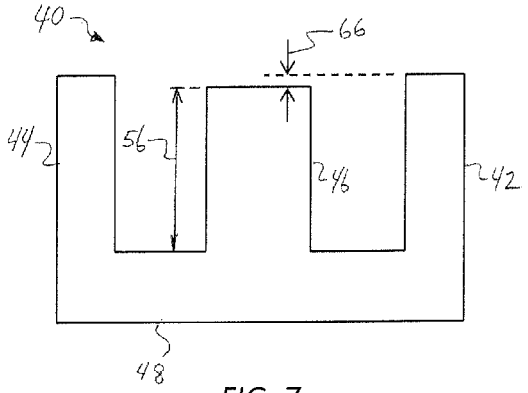
FIG. 7 is a plan view of an additional embodiment of a third E-core in accordance with the present invention.

Referring to FIG. 6, in some embodiments, third E-core 40 includes a middle third core leg 46 having a length substantially equal to the length of first and second outer third core legs 42, 44. In such embodiments, stepped air gap 70, seen in FIG. 2, is defined entirely by middle first core leg offset 62 and middle second core leg offset 64. However, in some applications, it may be desirable to modify the dimensions of stepped air gap 70 by reducing the length of middle third core leg 46. As seen in FIG. 7, in some embodiments, middle third core leg 46 has a middle third core leg length 56 that is less than the lengths of first and second outer third core legs 42, 44. As such, third E-core 40 includes a middle third core leg offset 66. In some embodiments, middle third core leg offset 66 is less than middle first core leg offset 62 and is also less than middle second core leg offset 64. In such embodiments stepped air gap 70 is defined by middle first core leg offset 62, middle second core leg offset 64, and middle third core leg offset 66. Third E-core 40 may include a standard middle third core leg offset 66 corresponding to a conventional E-core.

Figure 8:
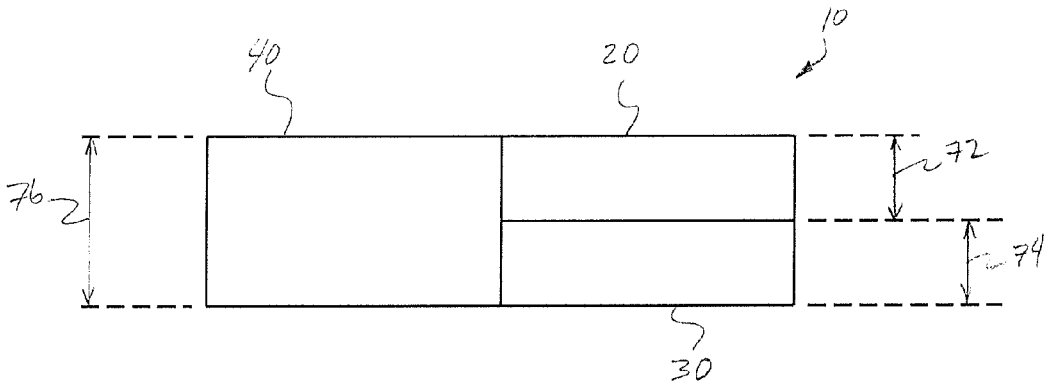
FIG. 8 is an end view of a core apparatus in accordance with the present invention.

Referring now to FIG. 8, core apparatus 10 includes a first E-core 20 having a first core thickness 72. Second E-core 30 has a second core thickness 74. Third E-core 40 has a third core thickness 76. In some embodiments, third core thickness 76 is substantially equal to the sum of the first and second core thicknesses 72, 74. In additional embodiments, first and second core thicknesses 72, 74 are substantially equal and are each one-half the thickness of third core 40.

In additional embodiments, the present invention provides various methods of forming core devices and magnetic components. A method of manufacturing a core apparatus includes the steps of: (a) providing first and second E-cores, the first E-core having a middle first core leg including a middle first core leg length, and the second E-core having a middle second core leg including a middle second core leg length greater than the middle first core leg length; (b) stacking the first and second E-cores such that the middle first core leg is positioned adjacent the middle second core leg, wherein the middle first core leg distal end and the middle second core leg distal end extend in substantially the same direction; and (c) providing a step between the middle first core leg distal end and the middle second core leg distal end.

In various additional embodiments in accordance with the present invention, the third E-core 40 may also include separate, stacked E-cores. In various other embodiments, more than two E-cores may be stacked to achieve a combined middle leg stepped end profile having more than one step. Also, in some embodiments a magnetic component such as an inductor or a transformer includes at least two stacked E-cores having differing middle leg lengths positioned opposite a third E-core such that a stepped air gap is formed between the opposing middle core legs.

Thus, although there have been described particular embodiments of the present invention of new and useful STACKED STEP GAP CORE DEVICES AND METHODS, it is not intended that such references be construed as limitations upon the scope of this invention except as set forth in the following claims.

What is claimed is:

1. A core apparatus for a magnetic component, comprising:

a first E-core having a first core thickness and including a first outer first core leg and a second outer first core leg, each having an outer first core leg length, and a middle first core leg having a middle first core leg length, the middle first core leg length being less than the outer first core leg length by a middle first core offset;

a second E-core having a second core thickness and including a first outer second core leg and a second outer second core leg, each having an outer second core leg length, and a middle second core leg having a middle second core leg length greater than the middle first core leg length, the middle second core leg length being less than the outer second core leg length by a middle second core offset less than the middle first core offset;

wherein the first and second E-cores are stacked against each other such that the middle first core leg and the middle second core leg extend in substantially the same direction;

wherein a difference between the middle first core offset and the middle second core offset forms a stepped end profile at exposed ends of the middle first core leg and the middle second core leg; and a third E-core positioned opposite the stacked first and second E-cores, the third E-core being a single non-stacked core and including a first outer third core leg, a second outer third core leg, and a middle third core leg, the middle third core leg having a constant middle third core leg length extending toward the stacked middle first and second core legs, the middle third core leg being shorter than the first and second outer third core legs by a middle third core leg offset, the middle third core leg offset being less than the middle second core offset, the third E-core having a third core thickness substantially equal to the sum of first and second core thicknesses.

2. The apparatus of claim 1, wherein:

the third middle core offset and the first middle core offset form a first gap between the middle first core leg and the middle third core leg, the first gap defining a first gap width, and the third middle core offset and the second middle core offset form a second gap between the middle second core leg and the middle third core leg, the second gap defining a second gap width less than the first gap width.

3. The apparatus of claim 2, wherein:

the first gap has a substantially uniform first gap width; and the second gap has a substantially uniform second gap width.

4. The apparatus of claim 1, wherein:

the first core thickness is substantially equal to the second core thickness.

5. The apparatus of claim 1, wherein when the third E-core is positioned opposite the first and second E-cores:

an end of the first outer first core leg and an end of the first outer second core leg abut an end of the first outer third core leg; and an end of the second outer first core leg and an end of the second outer second core leg abut an end of the second outer third core leg.

6. A core apparatus for a magnetic component, comprising:

a first E-core including a first core body and a first outer first core leg and a second outer first core leg, the first and second outer first core legs extending from the first core body at opposite ends of the first core body transversely to the first core body, the first E-core having a first core thickness and including a middle first core leg extending from the first core body between the first and second outer first core legs, the middle first core leg having a middle first core leg length, the first E-core having a middle first core leg offset; and a second E-core including a second core body and a first outer second core leg and a second outer second core leg, the first and second outer second core legs extending from opposite ends of the second core body transversely to the second core body, the second E-core having a second core thickness and including a middle second core leg extending from the second core body between the first and second outer second core legs, the middle second core leg having a middle second core leg length greater than the middle first core leg length, the second E-core having a middle second core leg offset, wherein the first and second E-cores are stacked such that the middle first core leg is positioned adjacent the middle second core leg;

a third E-core including a third core body and a first outer third core leg and a second outer third core leg, the first and second outer third core legs extending from opposite ends of the third core body transversely to the third core body, the third E-core being a single non-stacked core having a third core thickness and including a middle third core leg extending from the third core body between the first and second outer third core legs, the middle third core leg having a middle third core leg length that is less than the lengths of first and second outer third core legs, the third E-core having a middle third core leg offset, the middle third core leg offset being less than the middle first core leg offset and less than the middle second core leg offset;

wherein the third E-core is positioned opposite the first and second E-cores such that the first and second outer third core legs extend from the third core base toward the stacked first and second E-cores; and wherein the third core thickness is substantially equal to the sum of the first and second core thicknesses.

7. The apparatus of claim 6, further comprising:

a first gap defined between the middle third core leg and the middle first core leg, the first gap having a first gap width corresponding to a sum of the middle third core leg offset and the middle first core leg offset; and a second gap defined between the middle third core leg and the middle second core leg, the second gap having a second gap width corresponding to a sum of the middle third core leg offset and the middle second core leg offset, wherein the second gap width is less than the first gap width.

8. A method of assembling a core apparatus, comprising:

(a) providing a first E-core having a first outer first core leg and a second outer first core leg, each outer first core leg having an outer first core leg length, the first E-core further having a middle first core leg including having a middle first core leg length, the middle first core leg length less than the outer first core leg length by a middle first core leg offset, the first E-core having a first core thickness;

(b) providing a second E-core having a first outer second core leg and a second outer second core leg, each outer second core leg having an outer second core leg length, the second E-core having a middle second core leg including having a middle second core leg length, the middle second core leg length less than the outer second core leg length by a middle second core leg offset, the middle second core leg length greater than the middle first core leg length such that the middle second core leg offset is less than the middle first core leg offset, the second E-core having a second core thickness;

(c) stacking the first and second E-cores such that a distal end of the middle first core leg and a distal end of the middle second core leg extend in substantially the same direction and form a step between the distal end of the middle first core leg and the distal end of the middle second core leg; and (d) positioning a third single non-stacked E-core opposite the stacked first and second E-cores, the third E-core having a third core thickness substantially equal to a sum of the first and second core thicknesses, the third E-core including a middle third core leg having a middle third core leg length, a first outer third core leg and a second outer third core leg, each outer third core leg having an outer third core leg length, the middle third core leg length being less than the outer third core leg length by a middle third core leg offset, the middle third core leg offset less than the middle second core leg offset.

9. The method of claim 8, further comprising:

aligning the third E-core with the stacked first and second E-cores such that a sum of the middle third core leg offset and the middle first core leg offset form a first air gap and a sum of the middle third core leg offset and the middle second core leg offset form a second air gap such that a stepped air gap is provided between the middle third core leg and the stacked middle first and second core legs.

10. The method of claim 9, wherein:

the first and second core thicknesses are substantially equal.

* * * * *